US011655997B2

(12) United States Patent
Pingale et al.

(10) Patent No.: US 11,655,997 B2
(45) Date of Patent: May 23, 2023

(54) DAMPER BLADE ASSEMBLY FOR HVAC SYSTEM

(71) Applicant: Johnson Controls Technology Company, Auburn Hills, MI (US)

(72) Inventors: Sarjerao D. Pingale, Pune (IN); Bhushan C. Kadu, Pune (IN); Anil V. Bhosale, Karad (IN); Manjur Tamboli, Norman, OK (US)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 0 days.

(21) Appl. No.: 16/733,146

(22) Filed: Jan. 2, 2020

(65) Prior Publication Data

US 2021/0190369 A1 Jun. 24, 2021

Related U.S. Application Data

(60) Provisional application No. 62/951,371, filed on Dec. 20, 2019.

(51) Int. Cl.
*F24F 13/10* (2006.01)
*F24F 13/15* (2006.01)

(52) U.S. Cl.
CPC ..... *F24F 13/10* (2013.01); *F24F 13/15* (2013.01)

(58) Field of Classification Search
CPC ..... B60K 11/085; E04C 2/40; E06B 7/084; E06B 9/386; F24F 13/10; F24F 13/15; F24F 13/14; Y10T 29/49947; F03D 1/0683; F03D 1/0675; F05B 2240/301
USPC ..... 160/236; 454/333, 335, 336, 369
See application file for complete search history.

(56) References Cited

U.S. PATENT DOCUMENTS 3,290,823 A * 12/1966 Okumoto ..... E06B 7/084 49/403
3,547,152 A * 12/1970 Hess ..... F24F 13/1413 137/601.06
3,853,169 A * 12/1974 Music ..... E06B 9/302 160/172 R
4,382,460 A * 5/1983 Ben-Tal ..... E06B 7/084 160/236
4,610,197 A * 9/1986 Van Becelaere ..... F23L 13/08 137/601.09
4,889,040 A 12/1989 Man
5,732,507 A * 3/1998 Edwards ..... E04B 7/163 49/74.1

(Continued)

FOREIGN PATENT DOCUMENTS

CN 202300132 U * 7/2012
DE 1659724 A1 * 10/1969 ..... F16K 1/165

(Continued)

*Primary Examiner* — Edelmira Bosques
*Assistant Examiner* — Michael James Giordano
(74) *Attorney, Agent, or Firm* — Fletcher Yoder, PC

(57) ABSTRACT

A heating, ventilation, and/or air conditioning (HVAC) system includes a damper assembly configured to regulate airflow and having a frame. The HVAC system includes a first damper blade piece having a first airfoil surface and a second damper blade piece having a second airfoil surface. The first damper blade piece and the second damper blade piece are configured to couple with the frame, and are configured to interlock with one another to form a damper blade having an airfoil shape.

21 Claims, 12 Drawing Sheets

(56) References Cited

U.S. PATENT DOCUMENTS

| | | | | |
|---|---|---|---|---|
| 5,941,021 | A * | 8/1999 | Valls, Jr. | E06B 7/086 160/236 |
| 6,901,988 | B2 * | 6/2005 | Colson | E06B 9/30 160/176.1 R |
| 2009/0077894 | A1 | 3/2009 | King et al. | |
| 2010/0068065 | A1 * | 3/2010 | Jensen | F03D 3/062 416/241 R |
| 2014/0086735 | A1 | 3/2014 | Huang | |
| 2016/0116184 | A1 * | 4/2016 | Chappell | F24F 13/1406 454/335 |
| 2016/0216000 | A1 * | 7/2016 | Monahan | F24F 13/1413 |
| 2019/0242614 | A1 * | 8/2019 | Bannish | F24F 13/14 |

FOREIGN PATENT DOCUMENTS

| | | | | | |
|---|---|---|---|---|---|
| DE | 102004013533 | B3 | * | 7/2005 | E06B 9/386 |
| EP | 1223297 | A2 | * | 7/2002 | E06B 9/386 |
| EP | 2089665 | A1 | | 8/2009 | |
| FR | 2364389 | A3 | * | 4/1978 | E06B 9/386 |
| GB | 2203530 | A | * | 10/1988 | F24F 13/15 |
| GB | 2431958 | A | * | 5/2007 | E06B 7/084 |
| GB | 2516817 | A | * | 2/2015 | F24F 13/15 |
| JP | 61192866 | A | * | 8/1986 | F03D 1/0675 |
| JP | 2016003807 | A | * | 1/2016 | |
| KR | 20000018639 | U | * | 10/2000 | |
| KR | 100497930 | B1 | * | 6/2005 | |
| KR | 101017573 | B1 | * | 2/2011 | |
| KR | 101625923 | B1 | * | 5/2016 | |
| KR | 20180004524 | A | * | 1/2018 | |

* cited by examiner

DAMPER BLADE ASSEMBLY FOR HVAC SYSTEM

CROSS-REFERENCE TO RELATED APPLICATIONS

This application claims priority from and the benefit of U.S. Provisional Application Ser. No. 62/951,371, entitled "DAMPER BLADE ASSEMBLY FOR HVAC SYSTEM," filed Dec. 20, 2019, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system may regulate such environmental properties through control of an air flow delivered to the environment by a blower or a fan. Indeed, the blower may be configured to direct air along a flow path of the HVAC system and across a heat exchanger positioned within the flow path to facilitate exchange of thermal energy between the air and a refrigerant flowing through tubes of the heat exchanger. As such, the blower may direct conditioned air discharging from the heat exchanger to rooms or spaces within a building or other suitable structure serviced by the HVAC system.

The HVAC system generally includes various damper assemblies that are operable to regulate air flow along the flow path and/or throughout other sections of the HVAC system. For example, the damper assembly generally includes a plurality of damper blades or louvers that are configured to transition between open positions, closed positions, or various intermediate positions to enable or restrict air flow across the damper assembly and along the flow path. As such, the damper blades may facilitate regulating supply of conditioned air to and extraction of return air from the building. The damper blades are typically constructed from sheet metal or from another metallic material. Unfortunately, metallic damper blades may be difficult to manufacture and assemble, therefore increasing overall manufacturing costs of the HVAC system.

SUMMARY

The present disclosure relates to a heating, ventilation, and/or air conditioning (HVAC) system that includes a damper assembly configured to regulate airflow and having a frame. The HVAC system includes a first damper blade piece having a first airfoil surface and a second damper blade piece having a second airfoil surface. The first damper blade piece and the second damper blade piece are configured to couple with the frame, and are configured to interlock with one another to form a damper blade having an airfoil shape.

The present disclosure also relates to a damper assembly for a heating, ventilation, and/or air conditioning (HVAC) system. The damper assembly includes a frame and a damper blade pivotably coupled to the frame. The damper blade includes a first damper blade piece having a first interlocking feature and a second damper blade piece having a second interlocking feature. The first interlocking feature is engageable with the second interlocking feature to interlock the first damper blade piece and the second damper blade piece to form the damper blade.

The present disclosure also relates to a damper blade for a heating, ventilation, and/or air conditioning (HVAC) system. The damper blade includes a first damper blade piece having a first interlocking portion and a second damper blade piece having a second interlocking portion. The second interlocking portion is engageable with the first interlocking portion to interlock the first damper blade piece with the second damper blade piece to form a body of the damper blade having an airfoil shape.

DETAILED DESCRIPTION

Figure 1:
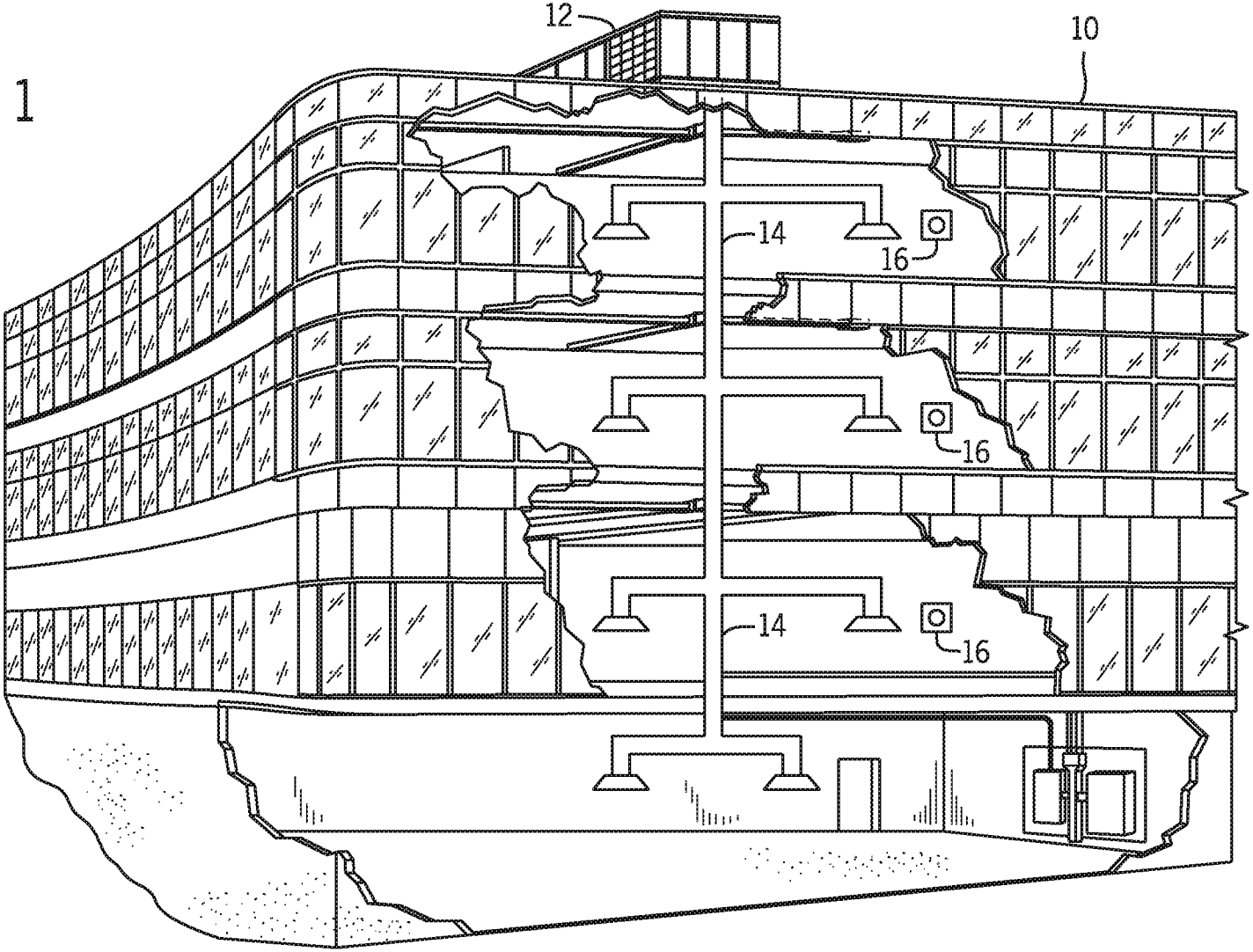
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A heating, ventilation, and/or air conditioning (HVAC) system may be used to thermally regulate a space within a building, home, or other suitable structure. The HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via conduits to form a refrigerant circuit. A compressor of the refrigerant circuit may be used to circulate the refrigerant through the conduits and enable the transfer of thermal energy between the condenser and the evaporator.

As briefly discussed above, the HVAC system generally includes a blower or a fan that is configured to direct an air flow along a flow path of the HVAC system and across a heat exchanger, such as the evaporator, positioned within the flow path. As such, the blower may facilitate heat exchange between the air flow and the refrigerant circulating through the evaporator. A damper assembly is typically positioned within the flow path and is configured to regulate a flow rate and/or a pressure drop of the air flow along the flow path. For example, the damper assembly generally includes a plurality of damper blades that are pivotably coupled to a frame or to another support structure of the damper assembly. As such, the damper blades may pivot between respective closed positions and various open positions to substantially block or enable, respectively, air flow along the flow path of the HVAC system. Indeed, the damper blades may be used to increase or decrease an effective cross-sectional area of a portion of the flow path through which air may flow in order to regulate air flow along the flow path.

In traditional systems, each of the damper blades is typically constructed from metallic blade pieces that are assembled to form the respective damper blade. Unfortunately, manufacturing metallic damper blades may be relatively costly, which increases overall manufacturing costs of the damper assembly and of the HVAC system. Moreover, conventional metallic damper blades may ineffectively engage with one another when the metallic damper blades are transitioned to respective closed positions in the damper assembly. As a result, even when the damper assembly is in a closed configuration, air may leak between the individual damper blades and across the damper assembly. Indeed, conventional damper assemblies may be ill-equipped to block substantially all air flow along the flow path of the HVAC system.

It is now recognized that constructing damper blades from one or more polymeric materials may facilitate manufacturing of the damper blades and may therefore reduce manufacturing costs associated with producing the damper blades. In particular, it is now recognized that manufacturing the damper blades via an extrusion process may enable manufacturing of the damper blades without involving arduous metal fabrication techniques that are generally implemented in the manufacture of typical damper blades. Moreover, it is now recognized that constructing damper blades from polymeric materials enables formation of integral blade sealing features with the damper blades that facilitate forming fluid seals and blocking air flow between adjacent damper blades when the damper blades are in closed positions within the damper assembly.

Accordingly, embodiments of the present disclosure are directed to a polymeric damper blade that is configured to reduce or substantially eliminate the shortcomings of conventional damper blades set forth above. For example, in some embodiments, the polymeric damper blade includes a first damper blade piece and a second damper blade piece that are formed from a polymeric material via an extrusion process. In particular, the first and second damper blades pieces may include self-similar components that are detached from a common stock of extruded, polymeric material. As discussed in detail below, the first and second damper blades pieces are configured to interlock with one another to collectively form a body of a particular damper blade. As such, the polymeric damper blades disclosed herein may be manufactured more easily than conventional damper blades that are typically assembled via crimping or metallurgical processes, such as welding or brazing. In some embodiments, each of the polymeric damper blades may include one or more integrated blade sealing features, also referred to herein as finger gaskets, which extend from respective edges of the damper blades. When the polymeric damper blades are in an installed configuration in a damper assembly, the finger gaskets of adjacent damper blades are configured to engage with one another when the damper blades are transitioned to closed positions to facilitate formation of a fluid seal between the adjacent damper blades in the damper assembly. As such, damper assemblies equipped with polymeric damper blades manufactured in accordance with the techniques discussed herein may more effectively block air flow along a flow path than damper assemblies having typical damper blades. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
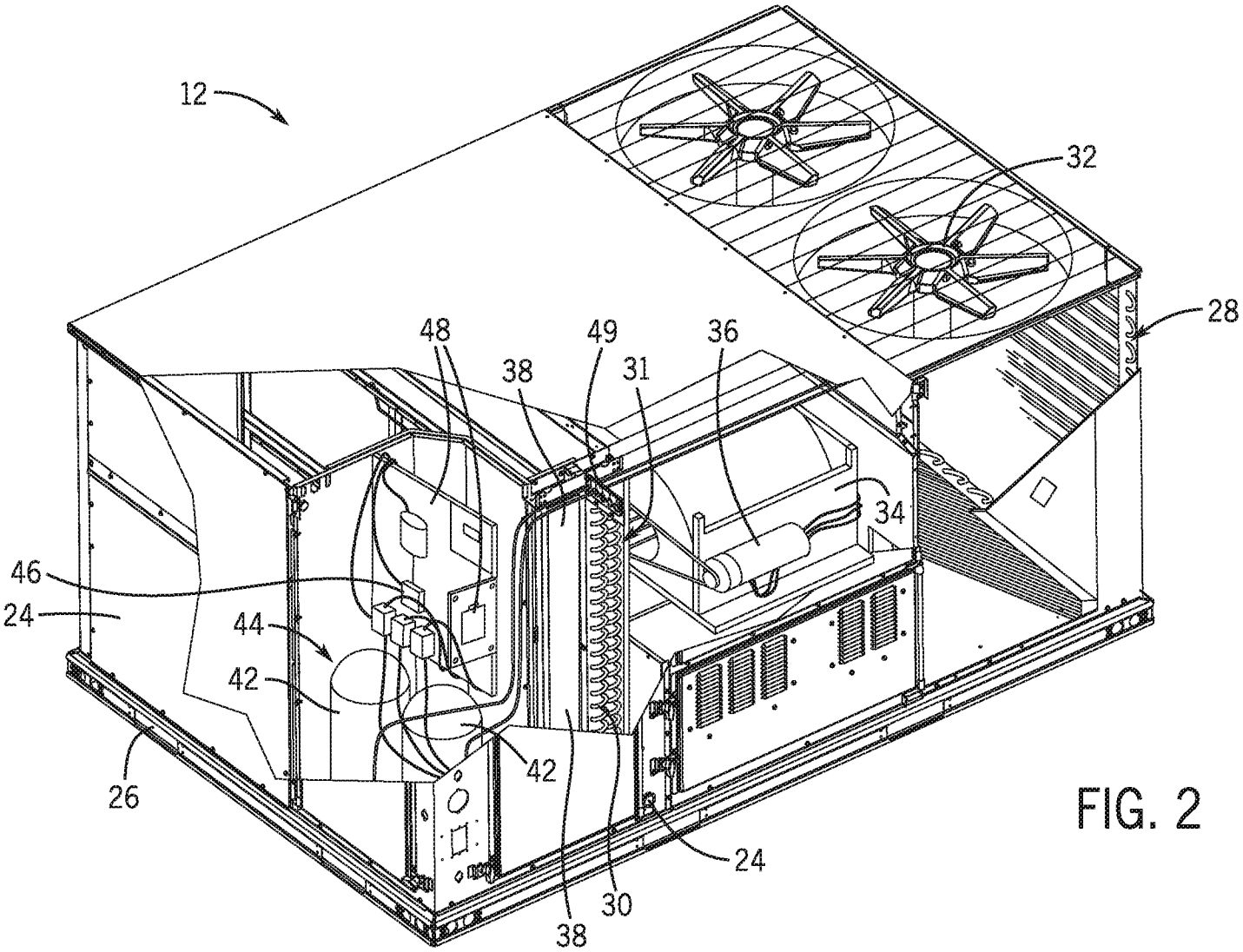
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
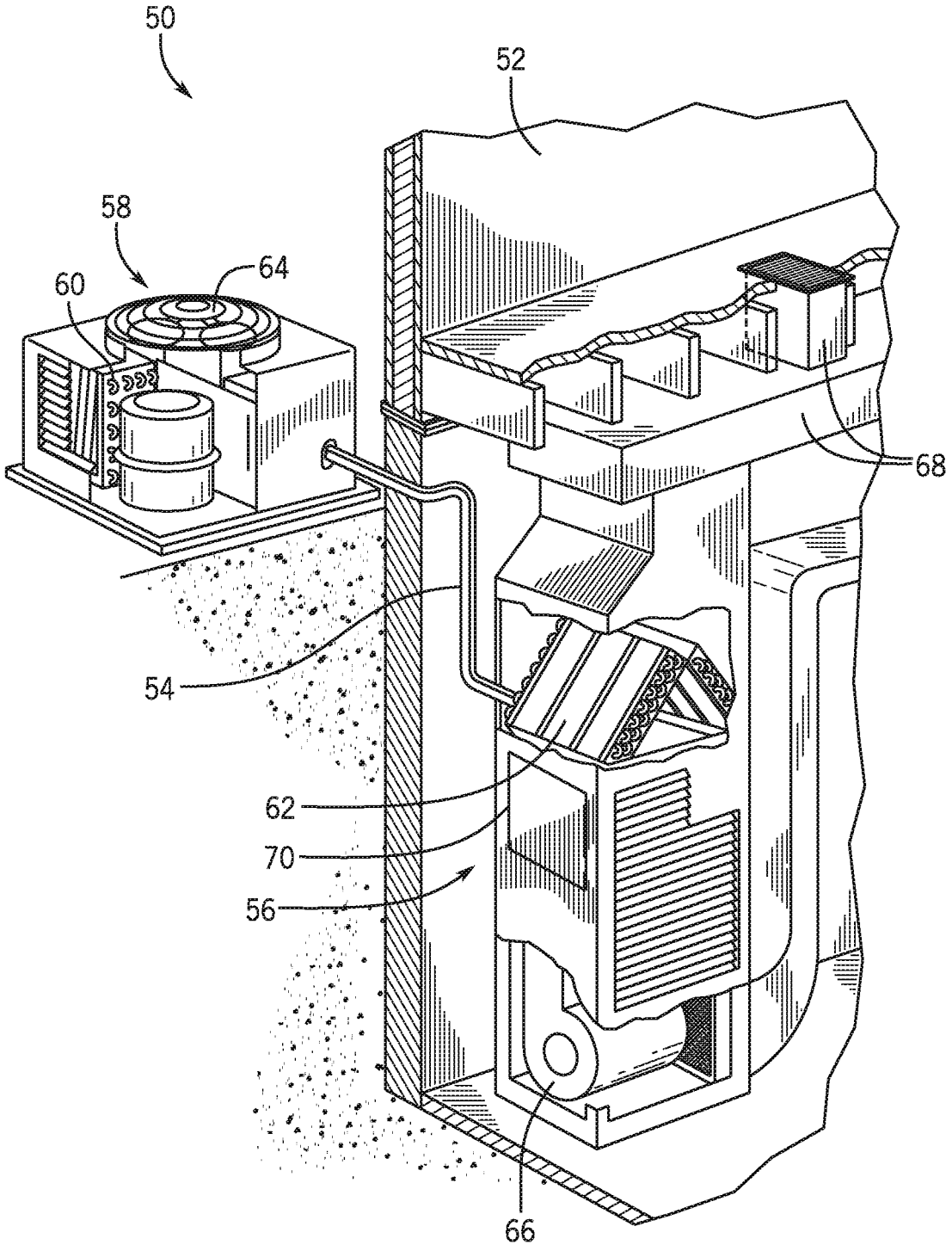
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
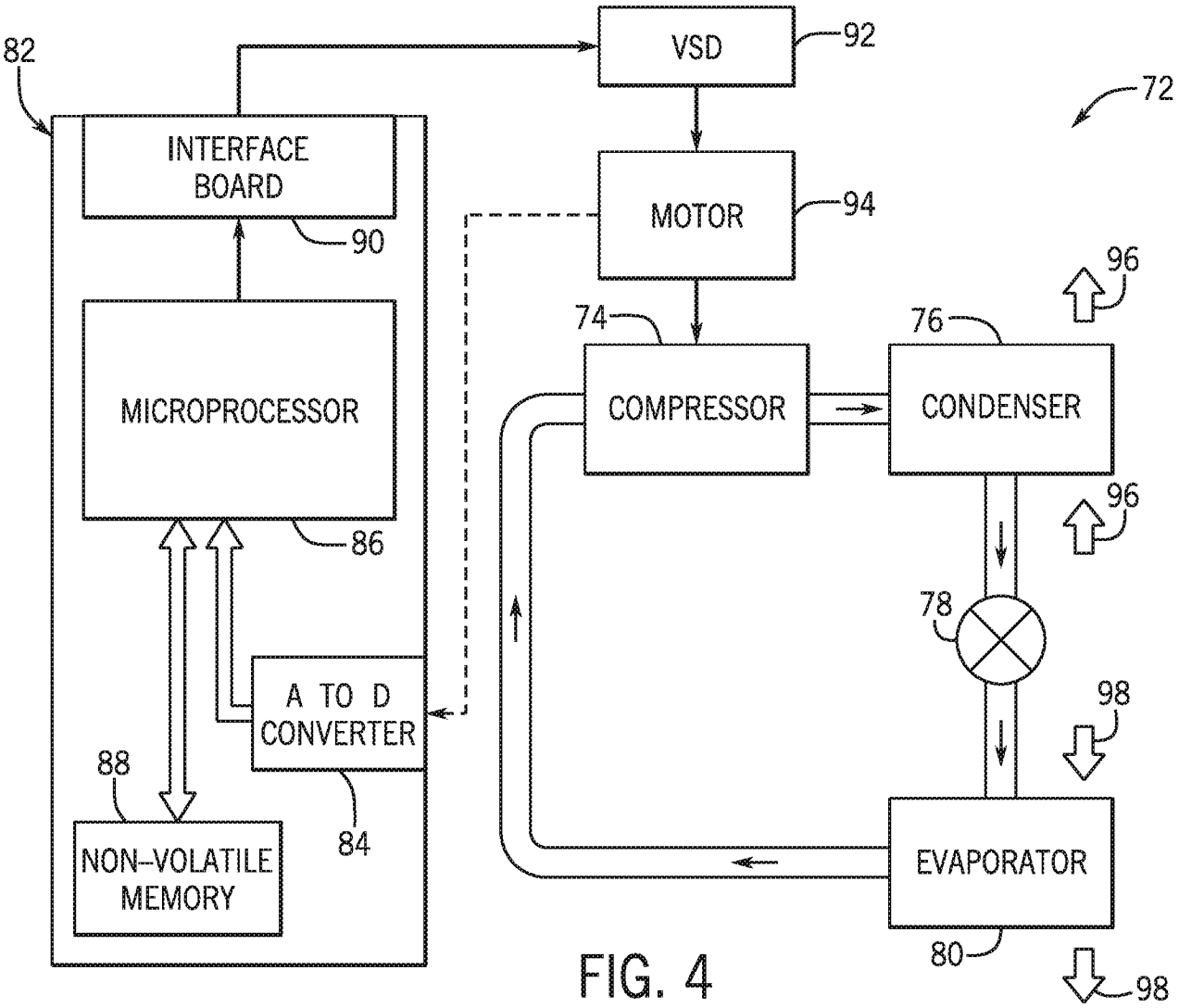
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, HVAC systems typically include a damper assembly having a plurality of actuatable damper blades that facilitate regulation of air flow along a flow path of the HVAC system. Typical damper blades are generally constructed from metallic blade pieces that are assembled to form the respective damper blades. Manufacturing of metallic damper blades may be costly, and thus, may increase overall manufacturing costs of the HVAC system. Moreover, metallic damper blades may ineffectively block air flow across the damper assembly when the damper assembly is transitioned to or position in a closed configuration. Accordingly, embodiments of the present disclosure are directed toward a polymeric damper blade that may be less costly to manufacture than metallic damper blades and that enhances an air-blocking ability of the damper assembly.

Figure 5:
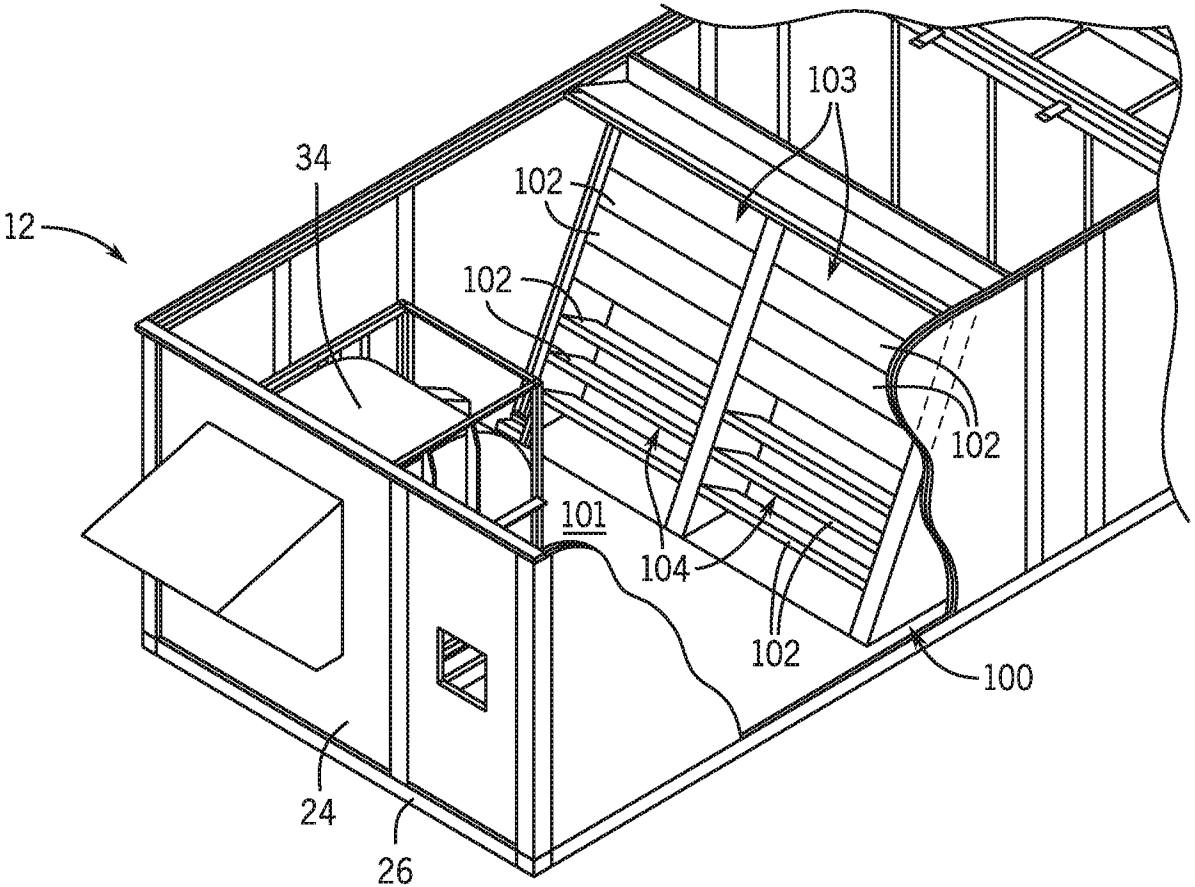
FIG. 5 is a perspective view of an embodiment of an HVAC unit that includes a damper assembly having polymeric damper blades, in accordance with an aspect of the present disclosure.

For example, to provide context for the following discussion, FIG. 5 is a perspective view of an embodiment of the HVAC unit 12 that includes a damper assembly 100. It should be understood that, in the illustrated embodiment of the HVAC unit 12, a portion of the cabinet 24 is removed to show components positioned within an interior of the HVAC unit 12, such as the damper assembly 100. The damper assembly 100 may be positioned within a suitable flow path 101 of the HVAC unit 12, which may be defined by the cabinet 24. The damper assembly 100 is configured to regulate air flow characteristics, such as flow rate and/or pressure drop, along the flow path 101. Indeed, as discussed in detail below, the damper assembly 100 includes a plurality of polymeric damper blades 102 that are configured to selectively transition between respective closed positons 103 and respective open positions 104 to restrict or enable air flow along the flow path 101. As such, the damper assembly 100 may be used to facilitate regulation of an air flow that may be forced along the flow path 101 via, for example, the blower 34.

It should be understood that embodiments of the damper assembly 100 and the damper blades 102 may also be included in embodiments or components of the split, residential HVAC system 50 shown in FIG. 3, a rooftop unit (RTU), or any other suitable HVAC system. Moreover, it should be understood that the embodiments of the damper blades 102 discussed herein are not limited to implementation on the damper assembly 100, and instead, may be configured for use on any suitable damper, vent register, or other flow control device or flow control mechanism.

Figure 6:
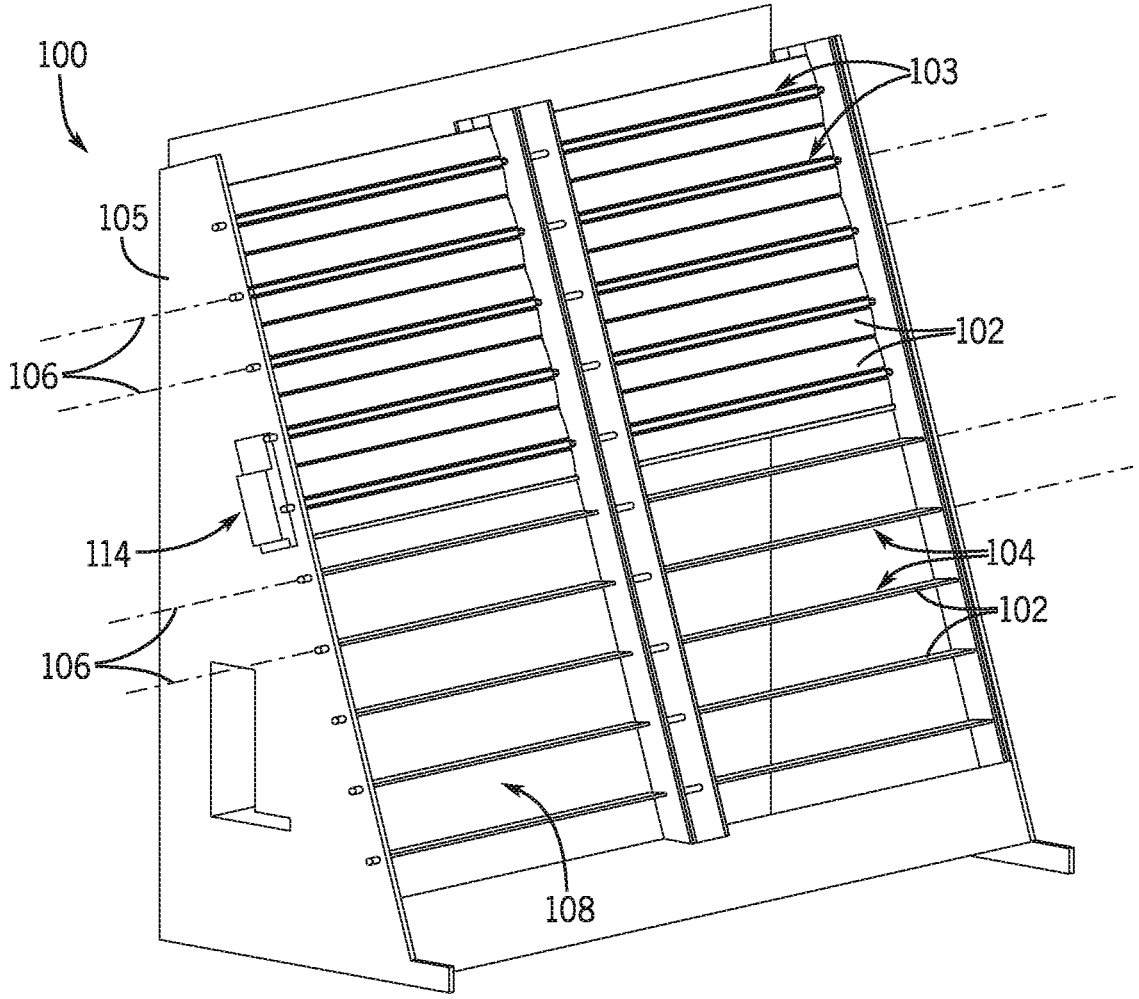
FIG. 6 is a perspective view of an embodiment of a damper assembly having polymeric damper blades, in accordance with an aspect of the present disclosure.

With the foregoing in mind, FIG. 6 is a perspective view of an embodiment of the damper assembly 100. In the illustrated embodiment, each of the damper blades 102 is pivotably coupled to a frame 105 or to a suitable support structure of the damper assembly 100. Accordingly, the damper blades 102 may pivot about respective axes 106 and relative to the frame 105 to facilitate air flow regulation through a central flow path 108 of the damper assembly 100, which may include a portion of the flow path 101. For example, as briefly discussed above, the damper blades 102 are selectively pivotable between the respective closed positions 103, in which the damper blades 102 substantially block air flow along the central flow path 108, and the respective open positions 104 or partially open positions, in which the damper blades 102 enable air flow along the central flow path 108. As discussed below, in some embodiments, one or more actuators 114 may be coupled to the damper blades 102 via suitable linkages or gearing mechanisms and configured to transition the damper blades 102 between the respective closed positions 103 and the respective open positions 104 or the partially open positions.

Figure 7:
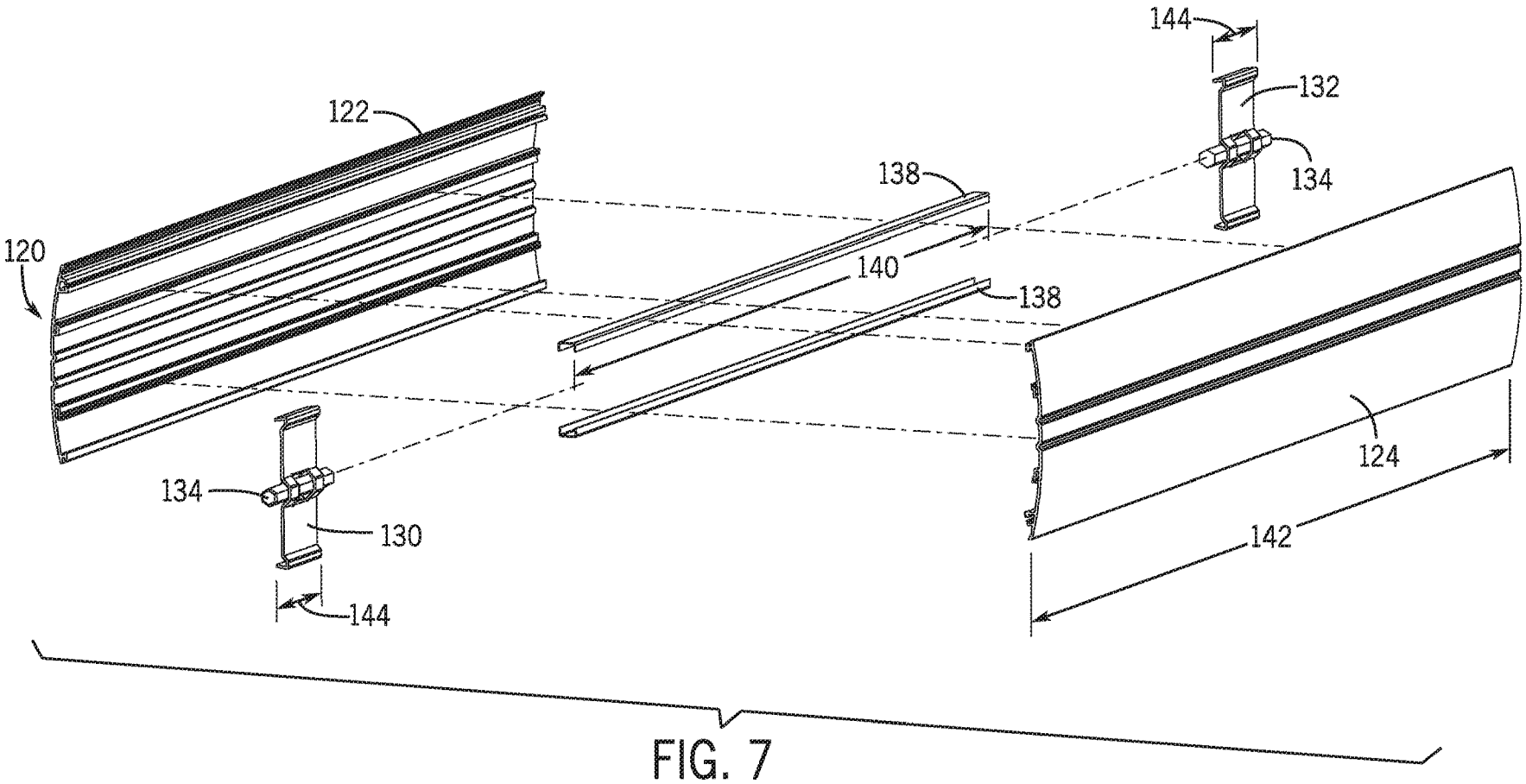
FIG. 7 is an exploded perspective view of an embodiment of a polymeric damper blade, in accordance with an aspect of the present disclosure.

FIG. 7 is an exploded perspective view of an embodiment one of the damper blades 102, referred to herein as a damper blade 120. As shown in the illustrated embodiment, the damper blade 120 includes a first damper blade piece 122 and a second damper blade piece 124 that may each include a generally curved profile. As discussed below, the first and second damper blade pieces 122, 124 are configured to interlock with one another to form a body 126, as shown in FIG. 8, of the damper blade 120, which may have an airfoil shape.

The damper blade 120 may include a first pivoting bracket 130 and a second pivoting bracket 132 that are configured to couple to and be positioned between the first and second damper blade pieces 122, 124 when the first and second damper blade pieces 122, 124 are interlocked to form the body 126. The first pivoting bracket 130 and the second pivoting bracket 132 may each include a respective pivot rod 134 that is configured to facilitate pivotable coupling of the damper blade 120 to the frame 105. For example, the pivot rods 134 may be configured to engage with respective bearings or bushings of the frame 105 to enable the damper blade 120 to pivot about a corresponding one of the axes 106, relative the frame 105, between corresponding closed and open positions 103, 104. In some embodiments, one or both of the pivot rods 134 may be coupled to the one or more actuators 114 via a linkage assembly, a gearing assembly, or another suitable mechanism. Accordingly, the one or more actuators 114 may be used to selectively pivot the damper blade 120 about the corresponding axis 106.

In some embodiments, the damper blade 120 includes one or more C-channel braces 138 that, similar to the first and second damper blade pieces 122, 124, are configured to couple to and be positioned between the first and second damper blade pieces 122, 124 when the first and second damper blade pieces 122, 124 are interlocked to form the body 126. In certain embodiments, the C-channel braces 138 may be formed from metal or from a rigid polymer and, as such, may enhance a structural rigidity of the body 126 when coupled to the first and second damper blade pieces 122, 124. In some embodiments, respective lengths 140 of the C-channel braces 138 may be less than respective lengths 142 of the first and second damper blade pieces 122, 124. Therefore, when coupled to the first and second damper blade pieces 122, 124, the C-channel braces 138 may be interposed between the first and second pivoting brackets 130, 132. Indeed, in some embodiments, respective lengths 144 of the first and second pivoting brackets 130, 132, combined with the length 140 of one of the C-channel braces 138, may define a cumulative length that is substantially equal to or less than the length 142 of the first or second damper blade pieces 122, 124.

Figure 8:
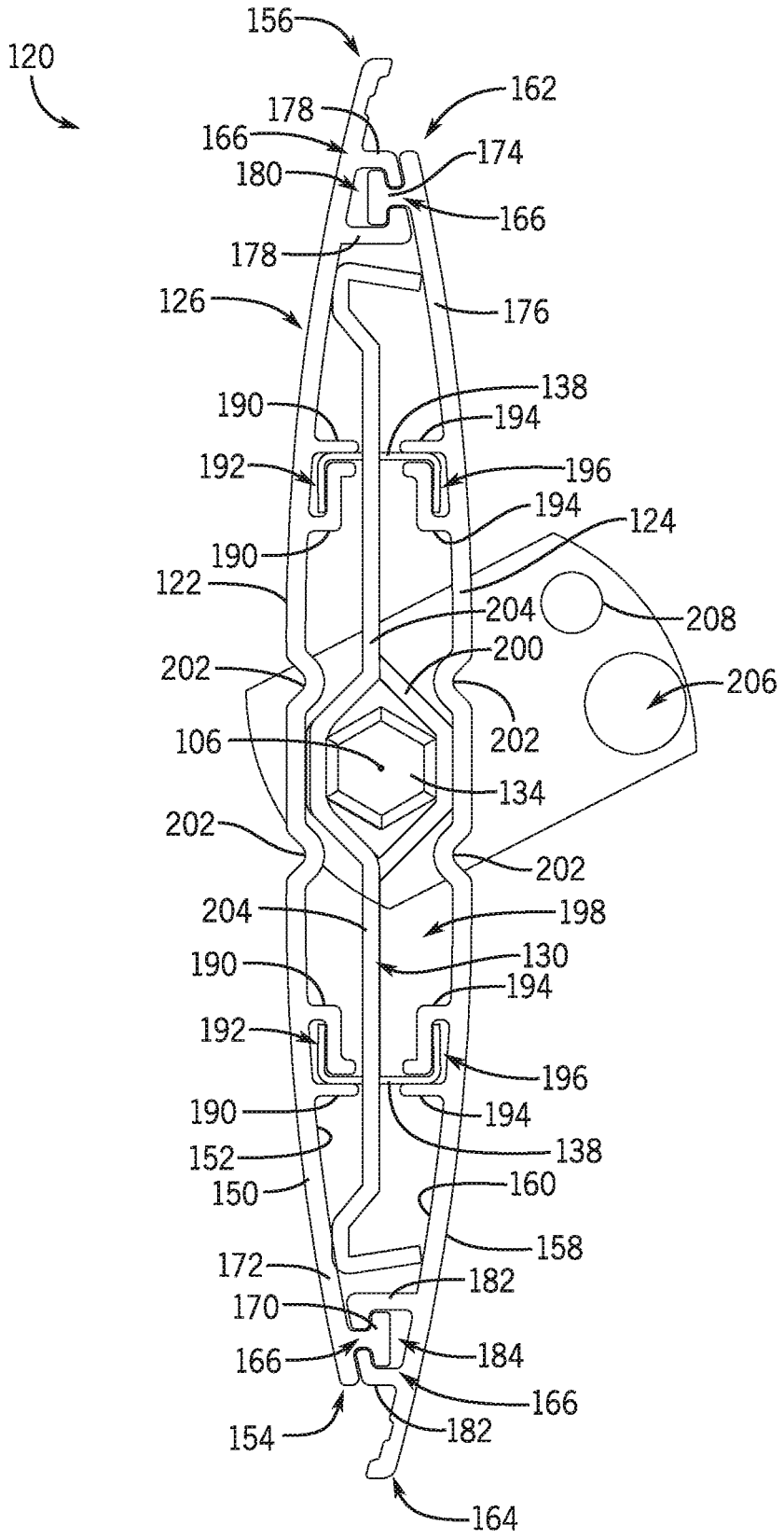
FIG. 8 is a side view of an embodiment of a polymeric damper blade, in accordance with an aspect of the present disclosure.

FIG. 8 is a side view of an embodiment of the damper blade 120. As shown in the illustrated embodiment, the first damper blade piece 122 includes a first airfoil surface 150 and a first inner surface 152 that is opposite to the first airfoil surface 150. As such, the first airfoil surface 150 and the first inner surface 152 may define opposing surfaces of the first damper blade piece 122 that extend between a first end portion 154 of the first damper blade piece 122 and a second end portion 156 of the first damper blade piece 122. Similar to the first damper blade piece 122, the second damper blade piece 124 includes a second airfoil surface 158 and a second inner surface 160 that is opposite to the second airfoil surface 158. Accordingly, the second airfoil surface 158 and the second inner surface 160 may define opposing surfaces of the second damper blade piece 124 that extend between a first end portion 162 of the second damper blade piece 124 and a second end portion 164 of the second damper blade piece 124.

As briefly discussed above, the first and second damper blade pieces 122, 124 may each include interlocking features 166 that are configured to engage with one another to couple or interlock the first and second damper blade pieces 122, 124 with one another to form the body 126. For example, in the illustrated embodiment, the first damper blade piece 122 includes a first protrusion 170 that extends outwardly from a first curved segment 172 of the first damper blade piece 122, and the second damper blade piece 124 includes a second protrusion 174 that extends outwardly from a second curved segment 176 of the second damper blade piece 124. As such, the first protrusion 170 may define a portion of the first inner surface 152 of the first damper blade piece 122, and the second protrusion 174 may define a portion of the second inner surface 160 of the second damper blade piece 124. For clarity, it should be understood that the first curved segment 172 may include a body portion of the first damper blade piece 122 that extends between the first and second end portions 154, 156 of the first damper blade piece 122, and that the second curved segment 176 may include a body portion of the second damper blade piece 124 that extends between the first and second end portions 162, 164 of the second damper blade piece 124.

The first damper blade piece 122 includes a first pair of prongs 178 that extend outwardly from the first curved segment 172 to define a first retention slot 180, and the second damper blade piece 124 includes a second pair of prongs 182 that extend outwardly from the second curved segment 176 to define a second retention slot 184. Accordingly, the first pair of prongs 178 and the second pair of prongs 182 may define portions of the first and second inner surfaces 152, 160, respectively. For clarity, it should be understood that the first protrusion 170 and the first retention slot 180 may define the interlocking features 166 of the first damper blade piece 122, and that the second protrusion 174 and the second retention slot 184 may define the interlocking features 166 of the second damper blade piece 124.

As shown in the illustrated embodiment, the first protrusion 170 is configured to engage with the second retention slot 184, and the second protrusion 174 is configured to engage with the first retention slot 180. Particularly, the first and second protrusions 170, 174 may be engaged with the second and first retention slots 184, 180, respectively, by translating the first and second damper blade pieces 122, 124 in opposing directions relative to one another along the axis 106. As such, the interlocking features 166 may engage with one another and facilitate interlocking the first and second damper blade pieces 122, 124 to form the body 126 of the damper blade 120. In some embodiments, respective interference fits between the first protrusion 170 and the second retention slot 184, and between the second protrusion 174 and the first retention slot 180, may facilitate retaining the first and second damper blade pieces 122, 124 in an engaged or interlocked configuration by blocking relative movement between the first and second damper blade pieces 122, 124 and/or disengagement of the first and second damper blade pieces 122, 124.

It should be appreciated that, in other embodiments, the first and second protrusions 170, 174 may be pressed into the second and first retention slots 184, 180, respectively, to facilitate coupling of the first and second damper blade pieces 122, 124 via a snap fit. To this end, the first and second protrusions 170, 174 and/or the first and second pairs of prongs 178, 182 may be formed of a resilient yet flexible material that enables elastic deformation. Moreover, it should be appreciated that, in other embodiments, the interlocking features 166 may include any other suitable shape, geometry, and/or orientation relative to one another. Indeed, the interlocking features 166 may include any suitable features that may be molded into or otherwise formed integrally with the first and second damper blade pieces 122, 124 and configured to engage with one another to facilitate interlocking of the first and second damper blade pieces 122, 124. As discussed above, it should be understood that the first and second damper blade pieces 122, 124 may be substantially self-similar components, such that the first damper blade piece 122 may include the same features as the second damper blade piece 124 and vice versa. In other words, the first and second damper blade pieces 122, 124 may be used interchangeably with one another. Indeed, as shown in the illustrated embodiment, the interlocking features 166 of the first damper blade piece 122 may be substantially self-similar to the interlocking features 166 of the second damper blade piece 124.

In some embodiments, the first damper blade piece 122 includes a first set of retention prongs 190 that extend outwardly from the first curved segment 172 to define first retention grooves 192 of the first damper blade piece 122. Similar to the first damper blade piece 122, the second damper blade piece 124 may include a second set of retention prongs 194 that extend outwardly from the second curved segment 176 to define second retention grooves 196 of the second damper blade piece 124. Accordingly, the first set of retention prongs 190 and the second set of retention prongs 194 may define portions of the first and second inner surfaces 152, 160, respectively. As shown in the illustrated embodiment, corresponding ones of the first and second retention grooves 192, 196 are configured to receive one of the C-channel braces 138. As such, the C-channel braces 138 may enhance a structural rigidity of the body 126 by coupling the first and second damper blade pieces 122, 124 to one another. It should be appreciated that an interference fit between the C-channel braces 138 and the corresponding first and second retention grooves 192, 196 may facilitate retention of the C-channel braces 138 within the first and second retention grooves 192, 196. Although the illustrated embodiment of the damper blade 120 includes two C-channel braces 138, in other embodiments, the damper blade 120 may include any suitable quantity of C-channel braces 138. Moreover, the C-channel braces 138 are not limited to channel-type shapes, and instead, may include any suitable shapes or geometries that facilitate coupling the first damper blade piece 122 to the second damper blade piece 124.

As shown in the illustrated embodiment, the first pivoting bracket 130 may be positioned between the first and second damper blade pieces 122, 124 and located within an interior region 198 of the body 126. In particular, the first pivoting bracket 130 may include a central portion 200 that is configured to be positioned between respective locating ribs 202 formed within the first and second damper blade pieces 122, 124. The central portion 200 may engage with the first and second inner surfaces 152, 160 via, for example, an interference fit between the central portion 200 and the first and second damper blade pieces 122, 124. The central portion 200 may include an inner geometry or inner profile that corresponds to or matches with an outer geometry or outer profile of the pivot rod 134 to facilitate torque transfer between the pivot rod 134 and the central portion 200. In some embodiments, the first pivoting bracket 130 may include opposing legs 204 that extend outwardly from the central portion 200 and are configured to engage with the first inner surface 152, the second inner surface 160, or both. In some embodiments, the legs 204 may facilitate transfer of rotational torque from the first pivoting bracket 130 to the first and second damper blade pieces 122, 124, such as when the one or more actuators 114 drive the pivot rods 134 about the axis 106. It should be understood that the second pivoting bracket 132 may include some of or all of the features of the first pivoting bracket 130 and may be configured to engage with the first and second damper blade pieces 122, 124 in a substantially similar manner as that of the first pivoting bracket 130 discussed above. Moreover, as noted above, it should be understood that the C-channel braces 138 may be interposed between the first and second pivoting brackets 130, 132.

In some embodiments, one or more flanges 206 may be coupled to the pivot rods 134 of the first pivoting bracket 130 and/or the second pivoting bracket 132 to facilitate coupling the pivots rods 134 to the one or more actuators 114. For example, in the illustrated embodiment, the flange 206 is coupled to the pivot rod 134 of the second pivoting bracket 132. The flange 206 may include a mounting aperture 208 that is engageable with a pivoting linkage or mechanism coupled to the one or more actuators 114. As such, the second pivoting bracket 132 and the pivoting linkage enable the one or more actuators 114 to induce motion of the damper blade 120 about the axis 106.

Figure 9:
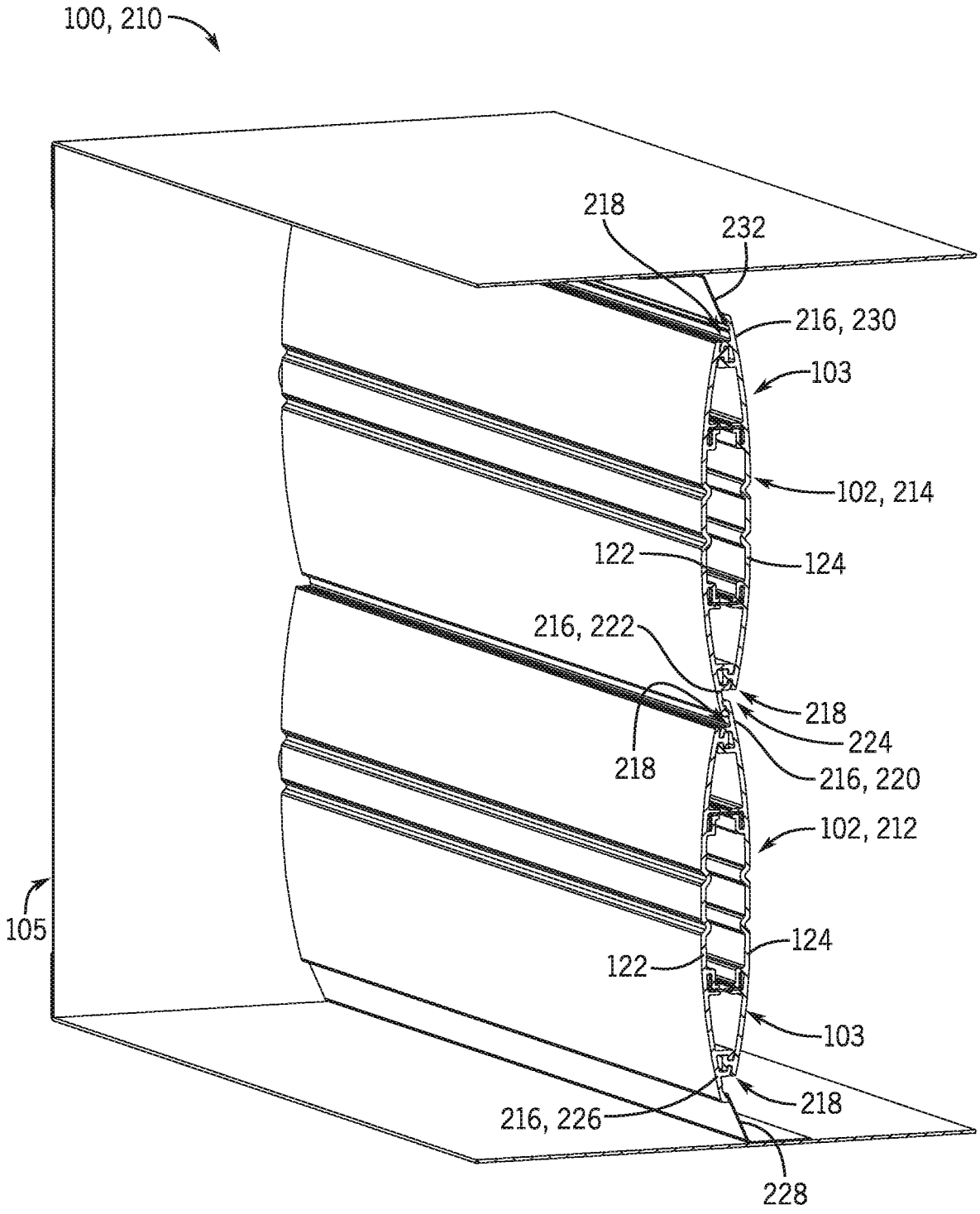
FIG. 9 is a cross-sectional perspective view of an embodiment of a damper assembly having polymeric damper blades, in accordance with an aspect of the present disclosure.

FIG. 9 is a perspective cross-sectional view of an embodiment of the damper assembly 100, referred to herein as a damper assembly 210, which includes a pair of the damper blades 102, such as a first damper blade 212 and a second damper blade 214. The first damper blade 212 and the second damper blade 214 may each include the features of the damper blade 120 discussed above. It should be appreciated that other embodiments of the damper assembly 210 may include any suitable quantity of the damper blades 102.

In the illustrated embodiment, the first and second damper blades 212, 214 each include finger gaskets 216 or blade sealing features that extend from respective edges 218 of the first and second damper blades 212, 214 and extend along respective lengths of the first and second damper blades 212, 214. In particular, the first damper blade 212 includes a first finger gasket 220 that is configured to engage with a second finger gasket 222 of the second damper blade 214 at an interface 224 when the first and second damper blades 212, 214 are transition to the closed positions 103. In this manner, the first and second finger gaskets 220, 222 may facilitate formation of a fluid seal between the first damper blade 212 and the second damper blade 214 at the interface 224. Moreover, as discussed in detail below, the first damper blade 212 includes a third finger gasket 226 that is configured to engage with a first gasket strip 228, which may be disposed along the frame 105, when the first damper blade 212 is in the respective closed position 103. Similarly, the second damper blade 214 includes a fourth finger gasket 230 that is configured to engage with a second gasket strip 232 disposed along the frame 105 when the second damper blade 214 is in the respective closed position 103. As such, the third finger gasket 226 may facilitate formation of a fluid seal between the first damper blade 212 and the first gasket strip 228 to substantially block air flow between the first gasket strip 228 and the first damper blade 212 when the first damper blade 212 is in the corresponding closed position 103, and the fourth finger gasket 230 may facilitate formation of a fluid seal between the second damper blade 214 and the second gasket strip 232 to substantially block air flow between the second gasket strip 232 and the second damper blade 214 when the second damper blade 214 is in the corresponding closed position 103. The first and second gasket strips 228, 232 may include sheet metal strips, rubber strips, or another other suitable material strips that are configured to engage with the third and fourth finger gaskets 226, 230 and form a fluid seal therewith.

Figure 10:
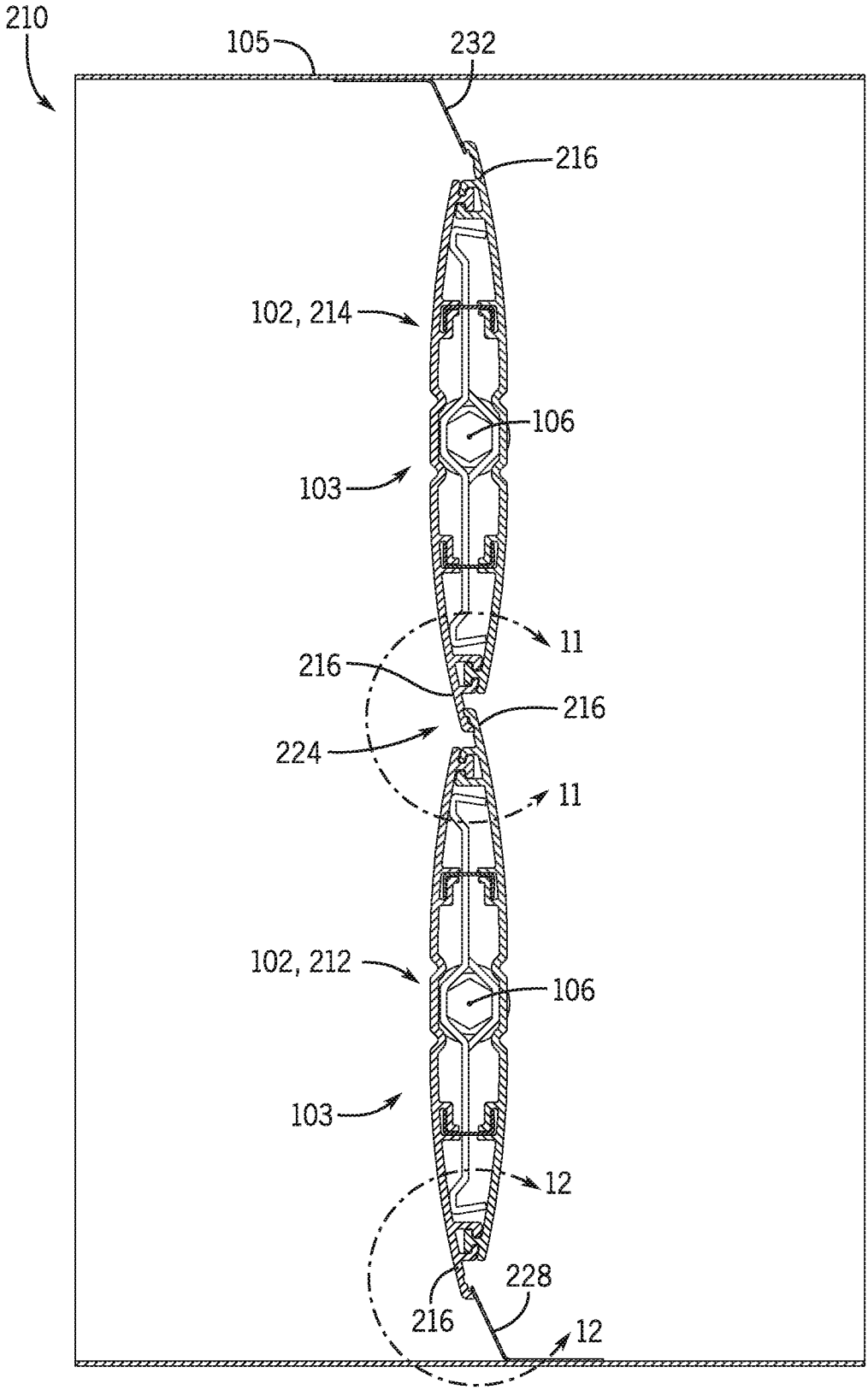
FIG. 10 is a cross-sectional side view of an embodiment of a damper assembly having polymeric damper blades, in accordance with an aspect of the present disclosure.
Figure 11:
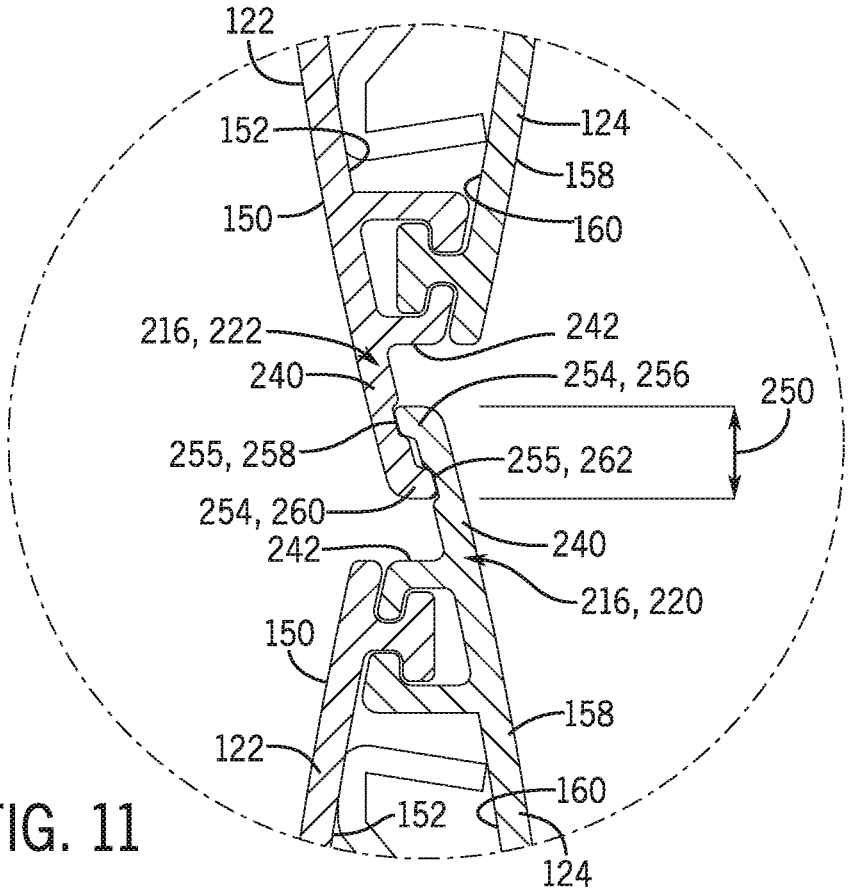
FIG. 11 is an expanded cross-sectional side view, taken within line 11-11 of FIG. 10, of an embodiment of finger gaskets of polymeric damper blades, in accordance with an aspect of the present disclosure.
Figure 12:
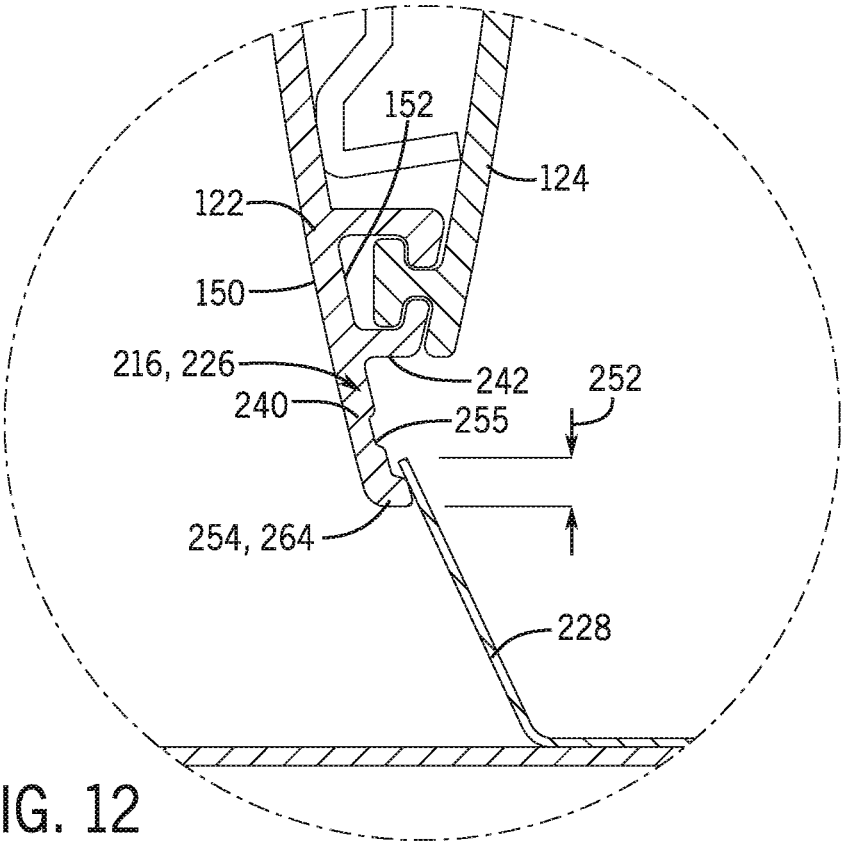
FIG. 12 is an expanded cross-sectional side view, taken within line 12-12 of FIG. 10, of an embodiment of a finger gasket of a polymeric damper blade, in accordance with an aspect of the present disclosure.

To better illustrate the finger gaskets 216 of the first and second damper blades 212, 214 and to facilitate the following discussion, FIG. 10 is a cross-sectional side view of the damper assembly 210. Additionally, FIG. 11 is an expanded cross-sectional side view taken within line 11-11 of FIG. 10, illustrating the engagement between the first finger gasket 220 and the second finger gasket 222 at interface 224. Further, FIG. 12 is an expanded side cross-sectional view taken within line 12-12 of FIG. 10, illustrating the engagement between the third finger gasket 226 and the first gasket strip 228. FIGS. 10, 11, and 12 are discussed concurrently below.

Each of the finger gaskets 216 include body portions 240 that extend from respective edges 242 of the first and second damper blade pieces 122, 124. Indeed, in some embodiments, the finger gaskets 216 may be formed integrally with the first and second damper blade pieces 122, 124 of the first and second damper blades 212, 214. As such, the body portions 240 may form respective portions of the first and second inner surfaces 152, 160 and of the first and second airfoil surfaces 150, 158 of the first and second damper blades 212, 214. It should be appreciated that, in other embodiments, the finger gaskets 216 may be separate components that may be coupled to the first or second damper blade pieces 122, 124 via adhesives or other suitable techniques.

In the closed positions 103 of the first and second damper blades 212, 214, the body portions 240 of the first and second finger gaskets 220, 222 may overlap with one another along a first region of overlap 250. Moreover, in the closed positions 103 of the first and second damper blades 212, 214, the third finger gasket 226 may overlap with the first gasket strip 228 along a second region of overlap 252, and the fourth finger gasket 230 may overlap with the second gasket strip 232 and a third region of overlap.

The finger gaskets 216 may each include a finger protrusion 254 that extends outwardly from the body portion 240 and a finger groove 255 formed in the body portion 240. In some embodiments, when the first and second damper blades 212, 214 are in the closed positions 103, a first finger protrusion 256 of the first finger gasket 220 may extend into and engage or mate with a corresponding first finger groove 258 of the second finger gasket 222. Additionally, when the first and second damper blades 212, 214 are in the closed positions 103, a second finger protrusion 260 of the second finger gasket 222 may extend into and engage or mate with a corresponding second finger groove 262 of the first finger gasket 220. The engagement between the first and second finger protrusions 256, 260 and the first and second finger grooves 258, 262, respectively, may facilitate formation of a fluid seal between the first damper blade 212 and the second damper blade 214 at the interface 224 when the damper blades 212, 214 are transitioned to the closed positions 103.

In some embodiments, the first and second finger gaskets 220, 222 may temporarily flex or bend when engaged with one another at the interface 224, such that a compressive force is applied between the first and second finger gaskets 220, 222 when the first and second damper blades 212, 214 are in the closed positions 103. As such, the compressive force between the first and second finger gaskets 220, 222 may ensure that the finger protrusions 256, 260 remain engaged with the corresponding finger grooves 258, 262 to form the fluid seal at the interface 224.

As shown in FIG. 12, a third finger protrusion 264 of the third finger gasket 226 is configured to contact and engage with the first gasket strip 228. Similar to the first and second finger gaskets 220, 222 discussed above, the third finger gasket 226 and the first gasket strip 228 may temporarily flex or bend when engaged with one another. As such, a compressive force may be applied between the third finger gasket 226 and the first gasket strip 228 that facilitates formation of a fluid seal between the third finger gasket 226 and the first gasket strip 228.

As discussed above, in certain embodiments, the first damper blade piece 122 may be substantially self-similar to the second damper blade piece 124. That is, the first damper blade piece 122 may include some of or all of the features of the second damper blade piece 124, and vice versa. Indeed, in some embodiments, the first damper blade piece 122 and the second damper blade piece 124 may be manufactured from, for example, a common stock of extruded polymer, such as polyvinyl chloride (PVC).

Figure 13:
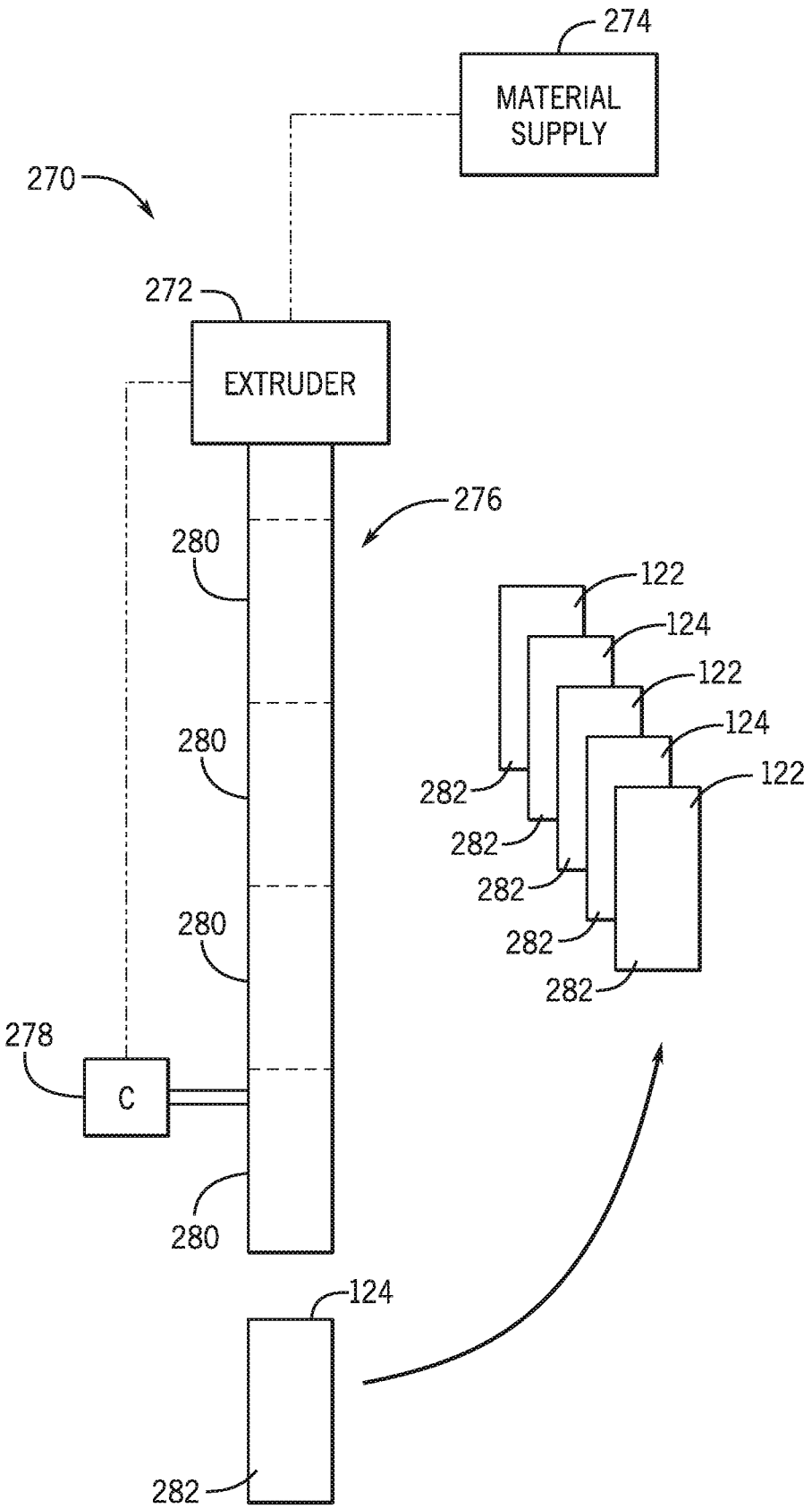
FIG. 13 is a schematic of an embodiment of an extrusion system for manufacturing polymeric damper blades, in accordance with an aspect of the present disclosure.

For example, to facilitate discussion of an embodiment of an extrusion process that may be used to manufacture the first and second damper blade pieces 122, 124, FIG. 13 is a schematic diagram of an extrusion system 270. As shown in the illustrated embodiment, the extrusion system 270 may include an extruder 272 that is configured to receive a supply of material from a material supply 274. For example, the material supply 274 may supply the extruder 272 with rolls, sheets, or pellets of a polymeric material or a mixture of polymeric materials. The extruder 272 may be configured to heat the polymeric material to a molten state or to an otherwise ductile state and to force the molten polymeric material through a guide to form a continuous strip of blade stock 276. The blade stock 276 may include a portion of or all of the features of the first and second damper blade pieces 122, 124 discussed above, such as, for example, the interlocking features 166 and the finger gaskets 216. That is, the guide of the extruder 272 may include a mold having geometries configured to form the features of the first and second damper blade pieces 122, 124 discussed herein.

In some embodiments, a cutting tool 278 may be used to detach individual sections 280 of the blade stock 276 to form a plurality of damper blade pieces 282. Each of the damper blade pieces 282 may be used as either the first damper blade piece 122 or the second damper blade piece 124. Indeed, it should be understood that, because the first damper blade piece 122 and the second damper blade piece 124 are self-similar, any two of the damper blade pieces 282 may be used to assemble the body 126 of the damper blade 120 or corresponding bodies of the first and second damper blades 212, 214. As such, the extrusion system 270 may facilitate rapid and cost effective manufacturing of the damper blades 102. Moreover, by adjusting a cutting distance by which the cutting tool 278 detaches the sections 280 from the blade stock 276, various sizes of damper blades 102 may be manufactured using the extrusion system 270. However, it should be appreciated that, in other embodiments, any other suitable manufacturing technique may be used to manufacture the first and second damper blade pieces 122, 124. As an example, the first and second damper blade pieces 122, 124 may be formed via a suitable additive manufacturing process or an injection molding process.

As set forth above, embodiments of the present disclosure may provide one or more technical effects useful for constructing damper blades from polymeric material to facilitate manufacturing of the damper blades and to reduce manufacturing costs associated with producing the damper blades. In particular, by manufacturing polymeric damper blades in accordance with the techniques disclosed herein, use of complicated metal fabrication machinery that may be implemented in the manufacture of typical metallic damper blades may be reduced or substantially eliminated. Moreover, embodiments of the damper blades discussed herein include blade sealing features, such as the finger gaskets, that enhance an ability of the damper blades to block airflow across the damper assembly when in respective closed positions. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a damper assembly configured to regulate airflow;

a frame of the damper assembly;

a first damper blade piece having a first curved airfoil surface and configured to couple with the frame;

a second damper blade piece having a second curved airfoil surface and configured to couple with the frame, wherein the first damper blade piece comprises a first inner surface opposite the first curved airfoil surface, the first inner surface comprises a protrusion and a first retention groove, the second damper blade piece comprises a second inner surface opposite the second curved airfoil surface, the second inner surface comprises a retention slot and a second retention groove, and wherein the protrusion is configured to interlock with the retention slot to couple the first damper blade piece to the second damper blade piece to form a damper blade having an airfoil shape;

a brace configured to interlock with the first retention groove and the second retention groove; and a pivot rod configured to pivotably couple the damper blade to the frame, wherein the first damper blade piece and the second damper blade piece are configured to couple about the pivot rod, and wherein the pivot rod is configured to pivot the damper blade about an axis that is fixed relative to the frame.

2. The HVAC system of claim 1, wherein the retention slot is a first retention slot, the protrusion is a first protrusion, the first inner surface comprises a second retention slot, the second inner surface comprises a second protrusion, and the second protrusion is configured to interlock with the second retention slot to couple the first damper blade piece to the second damper blade piece.

3. The HVAC system of claim 1, wherein the first damper blade piece and the second damper blade piece are self-similar.

4. The HVAC system of claim 3, wherein the first damper blade piece and the second damper blade piece are each an extruded polymer.

5. The HVAC system of claim 1, wherein the brace comprises a C-channel brace, wherein the C-channel brace is a first C-channel brace, the first inner surface includes a third retention groove, the second inner surface includes a fourth retention groove, and wherein the HVAC system includes a second C-channel brace configured to interlock with the third retention groove and the fourth retention groove.

6. The HVAC system of claim 1, wherein the first damper blade piece includes an edge and a finger gasket extending from the edge.

7. The HVAC system of claim 6, wherein the finger gasket forms a portion of the first inner surface of the first damper blade piece, wherein the portion of the first inner surface includes a finger protrusion and a finger groove that extend along a length of the first damper blade piece.

8. The HVAC system of claim 7, wherein the damper blade is a first damper blade, and the HVAC system includes a second damper blade, wherein the second damper blade includes a third damper blade piece having an additional finger gasket, wherein the additional finger gasket includes an additional finger protrusion and an additional finger groove, and wherein the finger protrusion of the finger gasket is configured to mate with the additional finger groove of the additional finger gasket, and the additional finger protrusion of the additional finger gasket is configured to mate with the finger groove of the finger gasket.

9. A damper assembly for a heating, ventilation, and/or air conditioning (HVAC) system, comprising:

a frame;

a damper blade pivotably coupled to the frame, wherein the damper blade comprises:

a first damper blade piece comprising a protrusion integrally formed with and extending from a first segment of the first damper blade piece; and a second damper blade piece comprising a groove formed in a second segment of the second damper blade piece, wherein the protrusion is engageable with the groove to interlock the first damper blade piece and the second damper blade piece to form the damper blade; and a pivot rod pivotably coupling the damper blade to the frame, wherein the first damper blade piece and the second damper blade piece are coupled about the pivot rod, and wherein the pivot rod enables the damper blade to pivot about an axis fixed relative to the frame; and a brace configured to interlock with and extend within a first retention groove of the first damper blade piece and a second retention groove of the second damper blade piece to couple the first damper blade piece and the second damper blade piece to one another.

10. The damper assembly of claim 9, wherein the second segment includes a pair of prongs that define the groove therebetween.

11. The damper assembly of claim 9, wherein the protrusion is a first protrusion and the groove is a first groove, wherein the first damper blade piece includes a second groove formed in the first segment of the first damper blade piece and the second damper blade piece includes a second protrusion integrally formed with and extending from the second segment of the second damper blade piece, wherein the second protrusion is engageable with the second groove to interlock the first damper blade piece and the second damper blade piece, the first protrusion and the second protrusion are self-similar, and the first groove and the second groove are self-similar.

12. The damper assembly of claim 9, wherein the damper blade is a first damper blade, and the damper assembly includes a second damper blade pivotably coupled to the frame and having a third damper blade piece interlocked with a fourth damper blade piece, wherein a first finger gasket extends outwardly from a first edge of the first damper blade piece and includes a first finger protrusion and a first finger groove, wherein a second finger gasket extends outwardly from a second edge of the third damper blade piece and includes a second finger protrusion and a second finger groove, and wherein the first finger protrusion of the first finger gasket is configured to engage with the second finger groove of the second finger gasket in respective closed positions of the first damper blade and the second damper blade within the frame.

13. The damper assembly of claim 12, wherein the second finger protrusion of the second finger gasket is configured to engage with the first finger groove of the first finger gasket in the respective closed positions of the first damper blade and the second damper blade.

14. The damper assembly of claim 9, wherein the first damper blade piece and the second damper blade piece are formed from a common stock of extruded polymer such that the first damper blade piece and the second damper blade piece are self-similar to one another.

15. The damper assembly of claim 9, wherein the first damper blade piece includes a first inner surface having the first retention groove and the second damper blade piece includes a second inner surface having the second retention groove.

16. The damper assembly of claim 15, wherein the damper blade includes a first pivoting bracket and a second pivoting bracket engaged with the first damper blade piece and the second damper blade piece, wherein the first pivoting bracket is coupled to the pivot rod, wherein the brace is a C-channel brace, and wherein the C-channel brace is interposed between the first pivoting bracket and the second pivoting bracket.

17. A damper blade for a heating, ventilation, and/or air conditioning (HVAC) system, comprising:

a first damper blade piece having a first curved airfoil surface and a first inner surface opposite the first curved airfoil surface, wherein the first inner surface comprises a protrusion and a first retention groove;

a second damper blade piece having a second curved airfoil surface and a second inner surface opposite the second curved airfoil surface, wherein the second inner surface comprises a groove and a second retention groove, wherein the groove is engageable with the protrusion to interlock the first damper blade piece with the second damper blade piece to form a body of the damper blade having an airfoil shape; and a brace configured to interlock with and extend within the first retention groove and the second retention groove to couple the first damper blade piece and the second damper blade piece to one another.

18. The damper blade of claim 17, wherein the first damper blade piece and the second damper blade piece are self-similar and are formed from a polymeric material.

19. The damper blade of claim 17, wherein the first damper blade piece includes a first finger gasket extending outwardly from a first edge of the first damper blade piece and the second damper blade piece includes a second finger gasket extending outwardly from a second edge of the second damper blade piece.

20. The damper blade of claim 17, wherein the brace comprises a C-channel brace.

21. The damper blade of claim 17, wherein the second inner surface comprises a pair of prongs defining the groove therebetween.

* * * * *